US010526764B2

(12) United States Patent
Elfass et al.

(10) Patent No.: US 10,526,764 B2
(45) Date of Patent: Jan. 7, 2020

(54) DEEP FOUNDATION POREWATER PRESSURE DISSIPATER

(71) Applicant: Board of Regents of the Nevada System of Higher Education on Behalf of the Unviersity of Nevada, Reno, Reno, NV (US)

(72) Inventors: Sherif A. Elfass, Reno, NV (US); Gary M. Norris, Reno, NV (US)

(73) Assignee: BOARD OF REGENTS OF THE NEVADA SYSTEM OF HIGHER EDUCATION ON BEHALF OF THE UNIVERSITY OF NEVADA, RENO, Reno, NV (US)

( * ) Notice: Subject to any disclaimer, the term of this patent is extended or adjusted under 35 U.S.C. 154(b) by 0 days.

(21) Appl. No.: 16/078,790

(22) PCT Filed: Feb. 21, 2017

(86) PCT No.: PCT/US2017/018744

§ 371 (c)(1),
(2) Date: Aug. 22, 2018

(87) PCT Pub. No.: WO2017/147083

PCT Pub. Date: Aug. 31, 2017

(65) Prior Publication Data

US 2019/0055714 A1 Feb. 21, 2019

Related U.S. Application Data

(60) Provisional application No. 62/298,252, filed on Feb. 22, 2016.

(51) Int. Cl.
*E02D 5/30* (2006.01)
*E02D 31/02* (2006.01)
(Continued)

(52) U.S. Cl.
CPC ..... *E02D 31/12* (2013.01); *E02D 3/00* (2013.01); *E02D 5/34* (2013.01); *E02D 15/04* (2013.01);
(Continued)

(58) Field of Classification Search
CPC .. E02D 5/30; E02D 5/24; E02D 31/10; E02D 31/08; E02D 31/02; E02D 3/08; E02D 3/10; E02D 3/103; E02D 3/106
(Continued)

(56) References Cited

U.S. PATENT DOCUMENTS 3,916,635 A 11/1975 Lynch et al.
4,018,056 A 4/1977 Poma
(Continued)

FOREIGN PATENT DOCUMENTS

CH 347788 A 7/1960
DE 1634486 A1 2/1971
(Continued)

OTHER PUBLICATIONS

Korean Intellectual Property Office, International Search Report and Written Opinion of the International Searching Authority for International Application No. PCT/US2017/018744, dated Apr. 21, 2017, 14 pages.
(Continued)

*Primary Examiner* — Sunil Singh
(74) *Attorney, Agent, or Firm* — Schwabe Williamson & Wyatt, P.C.

(57) ABSTRACT

A porewater pressure dissipater is disclosed. In one example, a disclosed dissipater includes aggregate; a cylindrical receptacle for receiving the aggregate; a plate having a top surface and a bottom surface and one or more openings transcending from the top surface to the bottom surface wherein the plate secures and compacts the aggregate in the
(Continued)

cylindrical receptacle; and one or more access tubes coupled to the top surface of the plate wherein the one or more access tubes are positioned over the one or more openings thereby forming a passageway to the cylindrical receptacle. The disclosed dissipater allows piles and shafts to be embedded at the optimum depth without concerns of liquefaction.

17 Claims, 4 Drawing Sheets

(51) Int. Cl.

| | |
|---|---|
| ***E02D 31/12*** | (2006.01) |
| ***E02D 3/00*** | (2006.01) |
| ***E02D 5/34*** | (2006.01) |
| ***E02D 15/04*** | (2006.01) |
| *E02D 27/12* | (2006.01) |
| *E02D 27/34* | (2006.01) |

(52) U.S. Cl.
CPC ..... *E02D 5/30* (2013.01); *E02D 27/12* (2013.01); *E02D 27/34* (2013.01); *E02D 31/02* (2013.01); *E02D 2250/00* (2013.01); *E02D 2250/0023* (2013.01); *E02D 2300/002* (2013.01); *E02D 2300/0085* (2013.01)

(58) Field of Classification Search
USPC ..... 405/50, 231–232, 271
See application file for complete search history.

(56) References Cited

U.S. PATENT DOCUMENTS

| | | | |
|---|---|---|---|
| 4,634,316 | A | 1/1987 | Cernak et al. |
| 6,869,255 | B1 | 3/2005 | Beck, III et al. |
| 7,909,541 | B1 | 3/2011 | Beck, III et al. |
| 2007/0231079 | A1 | 10/2007 | Gambill |
| 2011/0056303 | A1 | 3/2011 | Hayes |
| 2016/0115763 | A1 | 4/2016 | Lucido et al. |

FOREIGN PATENT DOCUMENTS

| | | | | |
|---|---|---|---|---|
| EP | 0193513 | A1 | | 9/1986 |
| FR | 1516805 | A | | 2/1968 |
| GB | 788633 | A | | 1/1958 |
| JP | 58-101926 | A | | 6/1983 |
| JP | 2-178413 | A | * | 7/1990 |
| JP | 3-8924 | A | * | 1/1991 |
| JP | 2553648 | B2 | | 11/1996 |
| JP | 10-195861 | A | * | 7/1998 |
| JP | 2001011849 | A | | 1/2001 |
| JP | 2009052202 | A | | 3/2009 |
| JP | 2013155558 | A | | 8/2013 |
| JP | 2015140609 | A | | 8/2015 |
| KR | 200313164 | Y1 | | 5/2003 |
| KR | 10-1051428 | B1 | | 7/2011 |
| WO | 8604941 | A1 | | 8/1986 |
| WO | 8605533 | A1 | | 9/1986 |
| WO | 2013089466 | A1 | | 6/2013 |

OTHER PUBLICATIONS

Korean Intellectual Property Office, International Search Report and Written Opinion of the International Searching Authority for International Application No. PCT/US2017/018757, dated Apr. 21, 2017, 12 pages.

* cited by examiner

DEEP FOUNDATION POREWATER PRESSURE DISSIPATER

CROSS-REFERENCE TO RELATED APPLICATIONS

This application is a 371 U.S. National Stage of International Application No. PCT/US2017/018744, filed Feb. 21, 2017, which was published in English under PCT Article 21(2), which in turn claims the priority benefit of the earlier filing date of U.S. Provisional Application No. 62/298,252, filed Feb. 22, 2016, which is hereby incorporated herein by reference in its entirety.

FIELD

The present disclosure relates generally to a water pressure dissipater and more particularly, to a deep foundation porewater pressure dissipater for dissipating generated water pressure under a pile or drilled shaft tip during an earthquake.

BACKGROUND

Pile or drilled shaft tips are sometimes embedded in saturated sandy soil. During a tectonic event, such as an earthquake, piles, or drilled shaft tips are subjected to porewater pressure buildup and soil softening or liquefaction can occur. Devices, systems and methods are needed to reduce or eliminate pressure buildup in order to eliminate developing or fully realized liquefaction and the associated loss of soil strength and pile/shaft tip support.

SUMMARY

Disclosed herein is a deep foundation porewater pressure dissipater, system, and methods of use thereof. The disclosed dissipater and system allows the generated water beneath a pile/shaft tip to dissipate through tubes to the surface thus eliminating developing or fully realized liquefaction and the associated loss of soil strength and pile/shaft tip support during conditions associated with excess water generation and thus pressure, including that which occurs during earthquakes.

In one embodiment, a disclosed dissipater comprises aggregate; a cylindrical receptacle for receiving the aggregate; a plate having a top surface and a bottom surface and one or more openings transcending from the top surface to the bottom surface wherein the plate secures and compacts the aggregate in the cylindrical receptacle; and one or more access tubes coupled to the top surface of the plate wherein the one or more access tubes are positioned over the one or more openings thereby forming a passageway to the cylindrical receptacle.

In some embodiments, the cylindrical receptacle comprises a material, such as a geosynthetic fabric or fine mesh formed of plastic or metal (e.g., wire mesh) which allows water to selectively pass through the fabric, but not the native soil.

In some embodiments, the aggregate is uniformly or nonuniformly sized.

In some embodiments, a diameter of the plate is approximately a diameter of a target pile or shaft body.

In some embodiments, the plate comprises metal or plastic.

In some embodiments, the one or more access tubes is permanently coupled to the top surface of the plate.

In some embodiments, the one or more access tubes is permanently coupled to the top surface of the plate comprises the one or more access tubes being welded to the top surface of the plate.

In some embodiments, a disclosed dissipater further comprises one or more coupling elements each comprising a first end and a second end wherein each first end is coupled to each access tube.

In some embodiments, the one or more coupling elements is permanently coupled to the top surface of the plate.

In some embodiments, a disclosed dissipater further comprises one or more additional access tubes each coupled to the one or more coupling elements wherein each of the one or more additional access tubes is coupled to each of the second ends of the one or more coupling elements.

In some embodiments, a disclosed dissipater further comprises one or more additional access tubes each coupled to the one or more coupling elements wherein each of the one or more additional access tubes is coupled to each of the second ends of the one or more coupling elements.

In some embodiments, each of the one or more additional access tubes is removably coupled to each of the one or more coupling elements.

In some embodiments, each of the one or more coupling elements comprises internal threads on an interior surface and the one or more additional access tubes comprise external threads complementing the internal threads of the one or more coupling elements.

Also disclosed is a method of assembling a porewater dissipater. In one embodiment, a method of assembling a porewater dissipater comprises arranging the aggregate in a cylindrical receptacle; coupling a plate on the cylindrical receptacle so that the plate compacts and seals the aggregate within the cylindrical receptacle wherein the plate comprises a top surface and a bottom surface and one or more openings transcending from the top surface to the bottom surface; and coupling an access tube to each of the openings within the plate, wherein each access tube is positioned around each opening to allow water to flow from a side or bottom surface of the cylindrical receptacle through the opening and into the access tube when in use, thereby forming an assembled porewater dissipater.

In some embodiments, the method further comprises positioning a coupling element on an end of each access tube to thereby allow an additional access tube to be coupled.

In some embodiments, the method further comprises attaching the top surface of the plate to a bottom of a steel cage of a pile or shaft body.

In some embodiments, the method further comprises positioning the assembled porewater dissipater which is attached to a steel cage of a pile or shaft body into a hole.

In some embodiments, the method further comprises coupling an additional access tube to each coupling element.

In some embodiments, the method further comprises pouring concrete into the pile or shaft body.

The foregoing and other features and advantages of the disclosure will become more apparent from the following detailed description, which proceeds with reference to the accompanying figures.

DETAILED DESCRIPTION

Porewater pressure refers to the pressure of groundwater held within a soil or rock, in gaps between particles. Porewater pressure is vital in calculating the stress state in the ground soil mechanics for the effective stress of a soil. Soil liquefaction describes a phenomenon whereby a saturated or partially saturated soil substantially loses strength and stiffness in response to an applied stress, usually earthquake shaking or other sudden change in stress condition, causing it to behave like a fluid.

If the pressure of the water in the pores is great enough to equal all the applied soil effective stress, it will have the effect of holding the particles apart and of producing a condition that is practically equivalent to that of quicksand—the initial movement of some part of the material might result in accumulating pressure, first on one point, and then on another, successively, as the early points of concentration were liquefied. Soil liquefaction is most often observed in saturated, loose (low density or uncompacted), sandy soils. This is because loose sand has a tendency to compress when a load is applied; dense sands by contrast tend to expand in volume. If the soil is saturated by water, a condition that often exists when the soil is below the ground water table or sea level, then water fills the gaps between soil grains ('pore spaces'). In response to the soil compressing, this water increases in pressure and attempts to flow out from the soil to zones of low pressure (usually upward towards the ground surface). However, if the loading is rapidly applied and large enough, or is repeated many times (e.g., earthquake shaking, storm wave loading) such that it does not flow out in time before the next cycle of load is applied, the water pressures may build to an extent where they exceed the contact stresses between the grains of soil that keep them in contact with each other. These contacts between grains are the means by which the weight from structures and overlying soil layers are transferred from the ground surface to layers of soil or rock at greater depths. This loss of soil structure causes it to lose all of its strength (the ability to transfer shear stress) and it may be observed to flow like a liquid (hence 'liquefaction'). The effects of soil liquefaction need to be considered in the design of new buildings and infrastructure such as bridges, embankment dams and retaining structures.

Currently, pile or drill shaft bodies are not positioned in potentially liquefiable soils because of the high risk of strength loss or excessive settlement. Thus, designers often elect to go deeper in the ground to avoid such impact. Disclosed herein is a deep foundation porewater pressure dissipater which allows piles and shafts to be embedded at the optimum depth without the above-mentioned concerns.

Figure 1A:
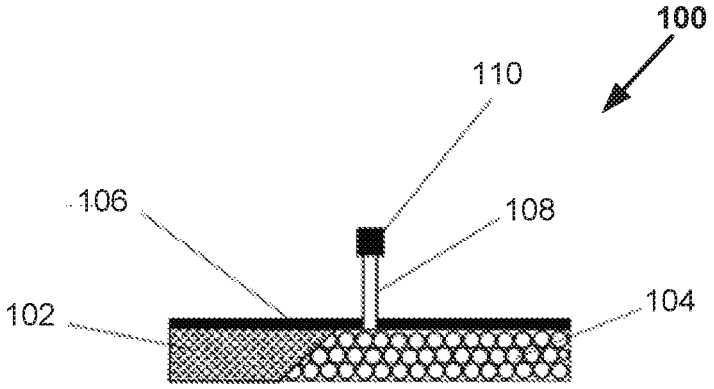
FIG. 1A is a cross-sectional view of a pressure dissipater module, according to one embodiment.
Figure 1B:
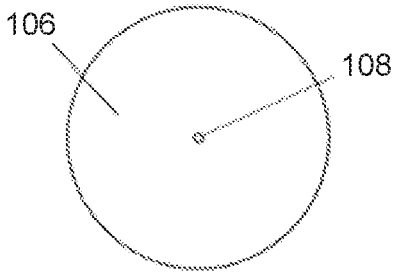
FIG. 1B is a plan view of components of the pressure dissipater module of FIG. 1A.
Figure 1C:
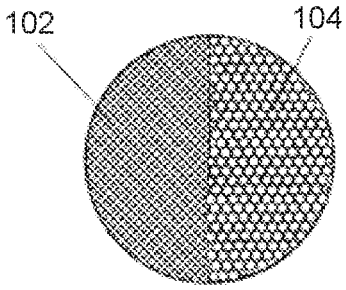
FIG. 1C is a partial bottom view of components of the pressure dissipater module of FIG. 1A.
Figure 2:
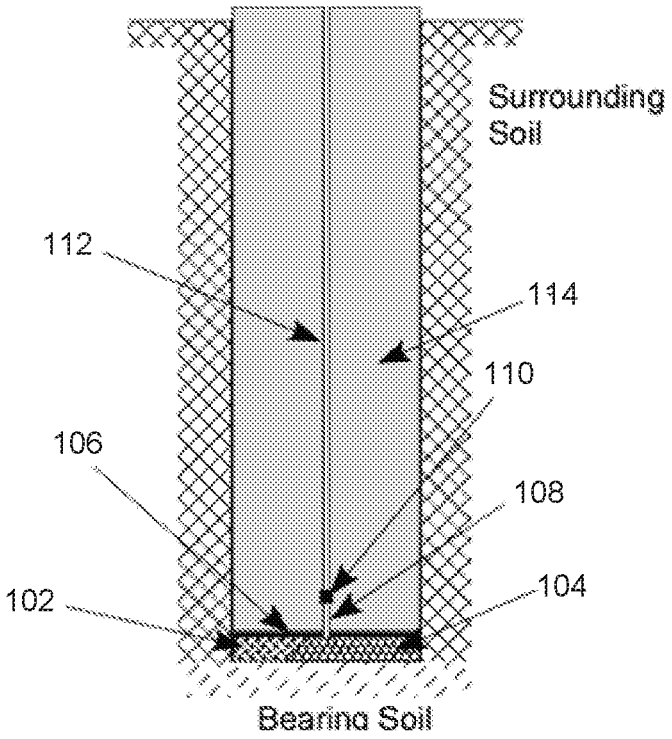
FIG. 2 is a partial cross-sectional view of a pressure dissipater module in a pile/shaft body, in accordance with an embodiment.

FIGS. 1A-2 illustrate components of a porewater pressure dissipater 100. FIG. 1A illustrates a cross-sectional view of many of these components. Dissipater 100 includes a cylindrical receptacle 102, aggregate 104, a plate or base portion 106, one or more access tubes 108, one or more couplers 110 and/or one or more additional access tubes 112.

Cylindrical receptacle 102 can be formed of any material that allows water to pass through, but not soil. In some examples, the cylindrical receptacle is formed of a rust resistant material, such as a geosynthetic fabric. In some examples, the cylindrical receptacle is made of a fine mesh made of plastic or metal such as a wire-mesh of a size that allows water to selectively flow through the receptacle, but not the native soil.

In one example, cylindrical receptacle 102 is formed of a geosynthetic fabric such as a woven, needle punched or heat bonded polyester and/or polypropylene fabric. In some examples, the material has a mesh size between 75 to 200 microns, such as between 75 to 125 microns, 100 to 200 microns, including about 75 microns, 100 microns, 125 microns, 150 microns, 175 microns or 200 microns. In some examples, the cylindrical receptacle is designed to have a diameter approximately equivalent to the diameter of the pile or shaft ±2 inches to which the dissipater is to be attached.

In some embodiments, a disclosed dissipater 100 comprises relatively uniform aggregate 104. In some embodiments, a disclosed dissipater 100 comprises relatively nonuniform aggregate 104. The shape and/or size of aggregate, including gravel, is such to maximize the void space and allow water to pass through without clogging it. In some examples, uniform aggregate shape and size range is within ±5%, such as ±4%, ±3%, ±2%, ±1%. In some examples, the aggregate is arranged to provide between a 3 inch sieve to No. 200 sieve. In one example, it forms a 3-inch sieve. In use, the uniformly shaped aggregate is placed in cylindrical receptacle 102, such as a geosynthetic bag, which has a similar diameter as the pile/shaft and allows water to pass from the soil on lateral and bottom sides of the pile/shaft tip, but not the native soil. In some embodiments, the disclosed dissipater comprises uniform or nonuniform aggregate, but not other substances, such as grout. In some embodiments, the disclosed dissipater comprises uniform aggregate, but not other substances, such as grout. In some embodiments, the disclosed dissipater comprises nonuniform aggregate, but not other substances, such as grout.

Disclosed dissipater 100 also includes a plate 106 coupled to cylindrical receptacle 102. As shown in FIG. 1B, plate 106 includes one or more openings within the body to receive one or more access tubes. Plate 106 comprises a top surface for coupling the dissipater 100 to a pile/shaft and a bottom surface for sealing the cylindrical receptacle 102. In some embodiments, plate 106 is a solid rigid plate with one or more openings. It is contemplated that plate 106 can be formed of any material that seals the dissipater 100, provides a flat surface thereby allowing the dissipater 100 to be attached to the pile/shaft, such as to a bottom steel cage of the pile/shaft. In some examples, plate 106 is in the form of metal or thermoset or thermosetting plastics, such as PVC, polyethylene terephthalate (PET or PETE), high-density polyethylene (HDPE) or polyethylene high-density (PEHD). It is contemplated that plate 106 can be coupled to the cylindrical receptacle 102 by any means that allows the dissipater 100 to be sealed. In some examples, the dimensions including the thickness and/or shape of plate 106 are determined by the size and shape of the pile shaft body, respectively, to which the dissipater 100 is to be coupled. In some examples, the thickness of the plate ranges between 0.25 inches and 2 inches. In one example, a plate with 0.25 inch thickness is used for a 1 foot wide pile shaft body. In another example, a plate with 2 inch thickness is used for a 12 foot wide pile shaft body. The plate surface is designed to have a diameter approximately equivalent to the diameter of the pile or shaft body ±2 inches to which the dissipater 100 is coupled. In some examples, plate 106 is circular.

As shown in FIG. 1A, disclosed dissipater 100 comprises an access tube 108. Access tube 108 comprises a first end and a second end. The first end of access tube 108 is coupled to plate 106 so that it is aligned around the opening within plate 106 thereby forming a passageway into the cavity of cylindrical receptacle 102. In some embodiments, a first end of access tube 108 is coupled to plate 106 by welding. In some embodiments, dissipater 100 also can include a coupling element 110 positioned on the second end of access tube 108 to allow coupling of an additional access tube 112 to dissipater 100 so that water can travel from dissipater 100 to an outlet surface. In some embodiments, coupling element 110 comprises internal threads on an interior surface to allow additional access tube 112 which comprises external threads complementing the internal threads of the coupling element 110 to be securely coupled to dissipater 100. Alternatively, in some embodiments a disclosed dissipater comprises one or more access tubes coupled to the one or more openings in the plate of sufficient length so that each tube reaches an outlet surface and does not require a coupling element or coupling of an additional access tubes.

In some embodiments, coupling element 110, access tube 108, and additional access tube 112 are formed of the same material. In some embodiments, coupler 110 and additional access tube 112 are formed of the same material while access tube 108 is formed of a different material. In some embodiments, the diameter of access tube 108 and additional access tube 112 are the same to facilitate the flow of water. The diameter of the access tubes 108 and 112 can be dependent upon the pile body/shaft diameter size. In use, access tube 112 passes through the body of a pile 114 all the way to an outlet surface where water can be safely discharged or be reused.

Figure 3A:
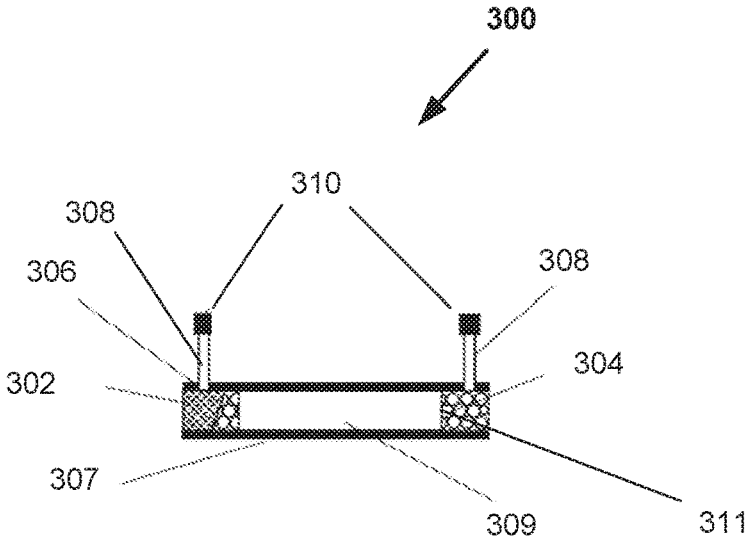
FIG. 3A is a cross-sectional view of a pressure dissipater module, according to one embodiment.
Figure 3B:
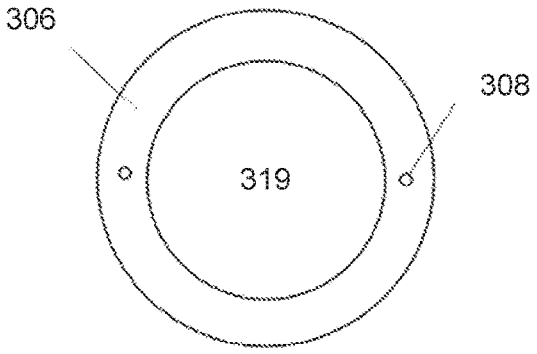
FIG. 3B is a plan view of components of the pressure dissipater module of FIG. 3A.
Figure 3C:
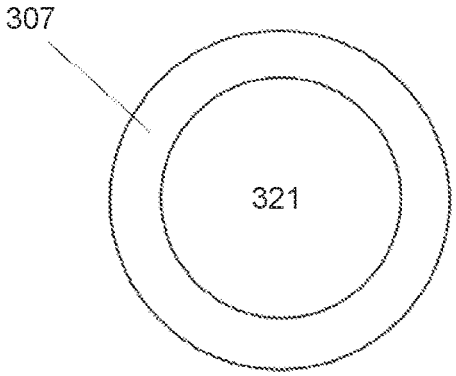
FIG. 3C is a plan view of components of the pressure dissipater module of FIG. 3A.
Figure 4:
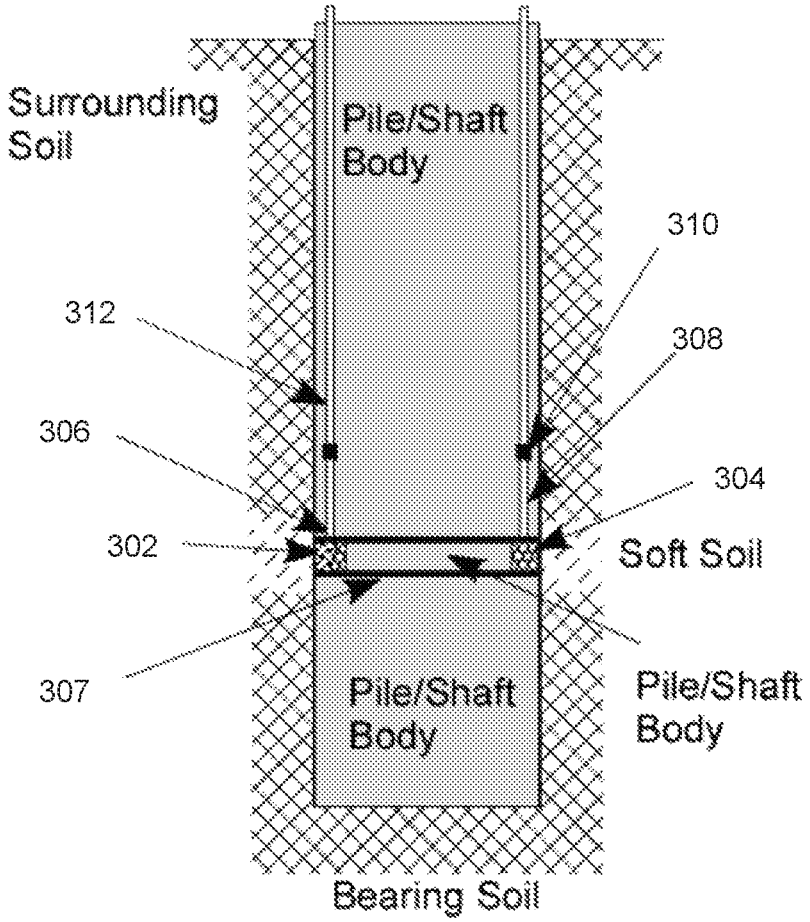
FIG. 4 is a partial cross-sectional view of a pressure dissipater module in a pile/shaft body, in accordance with an embodiment.

FIGS. 3A-4 illustrate components of a porewater pressure dissipater 300 that may be installed in the middle of the shaft. FIG. 3A illustrates a cross-sectional view of many of these components. Dissipater 300 includes a cylindrical receptacle 302, aggregate 304, a top plate 306, a bottom plate 307, one or more access tubes 308, one or more couplers 310, a hollow section 309 disposed between the top plate 306 and the bottom plate 307, and/or one or more additional access tubes 312.

In the embodiment shown, the hollow section 309 is formed the top plate 306 and the bottom plate 307 by inclusion of a wall 311 disposed between the top plate 306 and the bottom plate 307. The wall 311 separates the cylindrical receptacle 302 from the hollow section 309 and allows a pile or other such element to pass through the center of the porewater pressure dissipater 300. In some embodiments, wall 311 is coupled to the top plate 306 and the bottom plate 307, for example by welding.

Cylindrical receptacle 302 can be formed of any material that allows water to pass through, but not soil. In some examples, the cylindrical receptacle is formed of a rust resistant material, such as a geosynthetic fabric. In some examples, the cylindrical receptacle is made of a fine mesh made of plastic or metal such as a wire-mesh of a size that allows water to selectively flow through the receptacle, but not the native soil.

In one example, cylindrical receptacle 302 is formed of a geosynthetic fabric such as a woven, needle punched or heat bonded polyester and/or polypropylene fabric. In some examples, the material has a mesh size between 75 to 200 microns, such as between 75 to 125 microns, 100 to 200 microns, including about 75 microns, 100 microns, 125 microns, 150 microns, 175 microns or 200 microns. In some examples, the cylindrical receptacle is designed to have a diameter approximately equivalent to the diameter of the pile or shaft ±2 inches to which the dissipater is to be attached.

In some embodiments, a disclosed dissipater 300 comprises relatively uniform aggregate 304. In some embodiments, a disclosed dissipater 300 comprises nonuniform aggregate 304. The shape and/or size of aggregate, including gravel, is such to maximize the void space and allow water to pass through without clogging it. In some examples, uniform aggregate shape and size range is within ±5%, such as ±4%, ±3%, ±2%, ±1%. In some examples, the aggregate is arranged to provide between a 3 inch sieve to No. 200 sieve. In one example, it forms a 3-inch sieve. In use, the uniformly shaped aggregate is placed in cylindrical receptacle 302, such as a geosynthetic bag, which has a similar diameter as the pile/shaft and allows water to pass from the soil on lateral and bottom sides of the pile/shaft tip, but not the native soil. In some embodiments, the disclosed dissipater comprises uniform or nonuniform aggregate, but not other substances, such as grout. In some embodiments, the disclosed dissipater comprises uniform aggregate, but not other substances, such as grout. In some embodiments, the disclosed dissipater comprises nonuniform aggregate, but not other substances, such as grout.

Disclosed dissipater 300 includes top plate 306 coupled to cylindrical receptacle 302. As shown in FIG. 3B, top plate 306 includes one or more openings within the body to receive one or more access tubes. Top plate 306 comprises a top surface and a bottom surface for sealing the cylindrical receptacle 302. In some embodiments, top plate 306 is a solid rigid plate with one or more openings. It is contemplated that top plate 306 can be formed of any material that seals the dissipater 300, provides a hollow portion 319 thereby allowing the dissipater 300 to be attached to the pile/shaft, such as to the middle of the pile/shaft, for example allowing a portion of the pile to pass through the dissipater 300. In some examples, top plate 306 is in the form of metal or thermoset or thermosetting plastics, such as PVC, polyethylene terephthalate (PET or PETE), high-density polyethylene (HDPE) or polyethylene high-density (PEHD). It is contemplated that top plate 306 can be coupled to the cylindrical receptacle 302 by any means that allows the dissipater 300 to be sealed. In some examples, the dimensions including the thickness and/or shape of top plate 306 are determined by the size and shape of the pile shaft body, respectively, to which the dissipater 300 is to be coupled. In some examples, the thickness of the plate ranges between 0.25 inches and 2 inches. In one example, a plate with 0.25 inch thickness is used for a 1 foot wide pile shaft body. In another example, a plate with 2 inch thickness is used for a 12 foot wide pile shaft body. The plate surface is designed to have a diameter approximately equivalent to the diameter of the pile or shaft body ±2 inches to which the dissipater 300 is coupled. In some examples, the top plate 306 is circular.

Disclosed dissipater 300 also includes a bottom plate 307 coupled to cylindrical receptacle 302. As shown in FIG. 3C, bottom plate 307 comprises a top surface for sealing the cylindrical receptacle 302 and a bottom surface. In some embodiments, bottom plate 307 is a solid rigid plate with one or more openings. It is contemplated that bottom plate 307 can be formed of any material that seals the dissipater 300, provides a hollow portion 321 thereby allowing the dissipater 300 to be attached to the pile/shaft, such as within the body of the pile/shaft, including to the middle of the pile/shaft (such as a distance relatively equidistance from the bottom and top of the shaft), for example allowing a portion of the pile to pass through the dissipater 300. In some examples, bottom plate 307 is in the form of metal or thermoset or thermosetting plastics, such as PVC, polyethylene terephthalate (PET or PETE), high-density polyethylene (HDPE) or polyethylene high-density (PEHD). It is contemplated that bottom plate 307 can be coupled to the cylindrical receptacle 302 by any means that allows the dissipater 300 to be sealed. In some examples, the dimensions including the thickness and/or shape of bottom plate 307 are determined by the size and shape of the pile shaft body, respectively, to which the dissipater 300 is to be coupled. In some examples, the thickness of the plate ranges between 0.25 inches and 2 inches. In one example, a plate with 0.25 inch thickness is used for a 1 foot wide pile shaft body. In another example, a plate with 2 inch thickness is used for a 12 foot wide pile shaft body. The plate surface is designed to have a diameter approximately equivalent to the diameter of the pile or shaft body ±2 inches to which the dissipater 300 is coupled. In some examples, bottom plate 307 is circular.

As shown in FIG. 3A, disclosed dissipater 300 comprises an access tube 308. Access tube 308 comprises a first end and a second end. The first end of access tube 308 is coupled to top plate 306 so that it is aligned around the opening within top plate 306 thereby forming a passageway into the cavity of cylindrical receptacle 302. In some embodiments, a first end of access tube 308 is coupled to top plate 306 by welding. In some embodiments, dissipater 300 also can include a coupling element 310 positioned on the second end of access tube 308 to allow coupling of an additional access tube 312 to dissipater 300 so that water can travel from dissipater 300 to an outlet surface. In some embodiments, coupling element 310 comprises internal threads on an interior surface to allow additional access tube 312 which comprises external threads complementing the internal threads of the coupling element 310 to be securely coupled to dissipater 300. Alternatively, in some embodiments a disclosed dissipater comprises one or more access tubes coupled to the one or more openings in the plate of sufficient length so that each tube reaches an outlet surface and does not require a coupling element or coupling of an additional access tubes.

In some embodiments, coupling element 310, access tube 308, and additional access tube 312 are formed of the same material. In some embodiments, coupler 310 and additional access tube 312 are formed of the same material while access tube 308 is formed of a different material. In some embodiments, the diameter of access tube 308 and additional access tube 312 are the same to facilitate the flow of water. The diameter of the access tubes 308 and 312 can be dependent upon the pile body/shaft diameter size. In use, access tube 312 passes through the body of a pile all the way to an outlet surface where water can be safely discharged or be reused.

In some embodiments, a disclosed dissipater includes a plurality of openings in a plate, such as two, three, four, five, six, seven, eight, nine, ten or more openings thereby allowing a plurality of access tubes to be coupled and multiple passageways formed for water to flow from the bearing soil to an outlet surface. The number of access tubes and couplers may vary depending upon the conditions of the soil and support desired. For example, a 6 to 8 feet pile shaft can include multiple access tubes for facilitating dissipating pressure from water buildup. In some examples, one access tube is utilized for every two square-feet of a pile shaft body.

Also disclosed are methods of assembling a system for dissipation of excess water pressure, such as excess water generated during an earthquake. In some embodiments, methods are disclosed which comprise arranging uniform or non-uniform aggregate in a cylindrical receptacle, such as a bag formed of geosynthetic fabric. In some embodiment, the aggregate is grouped in smaller quantities and placed in small receptacles such as wire mesh. These small receptacles will be placed in the large cylindrical receptacle. In some embodiments, the disclosed methods comprise forming a cylindrical receptacle of a size similar to if not the same as the pile/shaft body to which the dissipater is to be attached. After arranging the aggregate in the cylindrical receptacle, a plate in positioned on the open end of the cylindrical receptacle and the aggregate is compacted if needed. The plate is then sealed to the cylindrical receptacle. As described above, a plate includes at least one opening and access tube positioned around the at least one opening to allow water to flow from a side or bottom surface of the cylindrical receptacle through the opening and into the access tube when in use. In some embodiments of the method, a coupling element is positioned on an end of the access tube to thereby allow an additional access to tube to be coupled to the dissipater. In some embodiments, the method further comprises attaching a disclosed dissipater to a bottom steel cage of a pile/shaft body, positioning the entire structure into a hole and positioning the one or more additional access tubes within their respective coupling elements. In some embodiments of the method, the method further comprises pouring concrete into the pile/shaft body via tremie concrete methods thereby forming a system which allows pressure to be dissipated from beneath the pile/shaft body caused by excess water generated during various conditions, including an earthquake or other tectonic events.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The invention claimed is:

1. A deep foundation porewater pressure dissipater, comprising:

aggregate;

a cylindrical receptacle formed to allow water to selectively pass through it and is for receiving the aggregate;

a top plate having a top surface and a bottom surface and one or more openings transcending from the top surface to the bottom surface wherein the top plate secures and compacts the aggregate in the cylindrical receptacle; and one or more access tubes coupled to the top surface of the top plate;

one or more coupling elements each comprising a first end and a second end wherein each first end is coupled to each access tube, thereby forming a passageway to the cylindrical receptacle and the deep foundation porewater pressure dissipater which allows water to flow from a bearing soil to an outlet surface and facilitating dissipating pressure from water buildup, wherein the dissipater has a through passage passing through the top plate, the cylindrical receptacle and a bottom plate of the dissipater to allow a portion of a pile or shaft body to pass through the dissipater.

2. The porewater pressure dissipater of claim 1, wherein the cylindrical receptacle comprises geosynthetic fabric which allows water to selectively pass through the fabric.

3. The porewater pressure dissipater of claim 1, wherein the aggregate is uniformly or nonuniformly sized.

4. The porewater pressure dissipater of claim 1, wherein a diameter of the top plate is a diameter of the pile or shaft body.

5. The porewater pressure dissipater of claim 1, wherein the top plate comprises metal.

6. The porewater pressure dissipater of claim 1, wherein the one or more access tubes is permanently coupled to the top surface of the top plate.

7. The porewater pressure dissipater of claim 6, wherein the one or more access tubes permanently coupled to the top surface of the top plate are welded to the top surface of the top plate.

8. The porewater pressure dissipater of claim 1, wherein the one or more coupling elements is permanently coupled to the top surface of the top plate.

9. The porewater pressure dissipater of claim 1, further comprising one or more additional access tubes each coupled to the one or more coupling elements wherein each of the one or more additional access tubes is coupled to each of the second ends of the one or more coupling elements.

10. The porewater pressure dissipater of claim 9, wherein each of the one or more additional access tubes is removably coupled to each of the one or more coupling elements.

11. The porewater pressure dissipater of claim 10, wherein each of the one or more coupling elements comprises internal threads on an interior surface and the one or more additional access tubes comprise external threads complementing the internal threads of the one or more coupling elements.

12. A method of assembling a deep foundation porewater dissipater, comprising:

arranging uniform or nonuniform aggregate in a cylindrical receptacle;

coupling a top plate and a bottom plate to the cylindrical receptacle so that the top plate compacts the aggregate and the bottom plate seals the aggregate within the cylindrical receptacle wherein the top plate comprises a top surface and a bottom surface and one or more openings transcending from the top surface to the bottom surface; and coupling an access tube to each of the openings within the top plate by one or more coupling elements each of which comprises a first end and a second end thereby forming a passageway to the cylindrical receptacle allowing water to flow from a side or bottom surface of the cylindrical receptacle through the opening and into the access tube when in use, thereby forming an assembled deep foundation porewater dissipater capable of facilitating dissipating pressure from water buildup, and wherein the dissipater has a through passage passing through the top plate, the cylindrical receptacle and a bottom plate of the dissipater to allow a portion of a pile or shaft body to pass through the dissipater.

13. The method of claim 12, further comprising positioning a coupling element on an end of each access tube to thereby allow an additional access tube to be coupled.

14. The method of claim 13, further comprising coupling the additional access tube to each coupling element.

15. The method of claim 12, further comprising attaching the top plate to a bottom of a steel cage of the pile or shaft body.

16. The method of claim 15, further comprising positioning the assembled porewater dissipater which is attached to the steel cage of the pile or shaft body into a hole.

17. The method of claim 16, further comprising pouring concrete into the pile or shaft body.

* * * * *